US010330329B2

(12) United States Patent
Baker et al.

(10) Patent No.: US 10,330,329 B2
(45) Date of Patent: Jun. 25, 2019

(54) INDIRECT GAS FURNACE

(71) Applicant: Greenheck Fan Corporation, Schofield, WI (US)

(72) Inventors: Eric Baker, Schofield, WI (US); Brandon Krautkramer, Schofield, WI (US)

(73) Assignee: Greenheck Fan Corporation, Scholfield, WI (US)

( * ) Notice: Subject to any disclaimer, the term of this patent is extended or adjusted under 35 U.S.C. 154(b) by 205 days.

(21) Appl. No.: 15/253,490

(22) Filed: Aug. 31, 2016

(65) Prior Publication Data

US 2018/0038601 A1 Feb. 8, 2018

Related U.S. Application Data

(60) Provisional application No. 62/371,419, filed on Aug. 5, 2016.

(51) Int. Cl.

| | |
|---|---|
| ***F24D 19/10*** | (2006.01) |
| ***F24D 5/02*** | (2006.01) |
| ***F24H 9/18*** | (2006.01) |
| ***F24H 3/00*** | (2006.01) |
| ***F24H 9/20*** | (2006.01) |
| ***F24H 3/08*** | (2006.01) |

(Continued)

(52) U.S. Cl.

CPC ..... *F24D 19/1084* (2013.01); *F24D 5/02* (2013.01); *F24H 3/006* (2013.01); *F24H 3/087* (2013.01); *F24H 9/1881* (2013.01); *F24H 9/2085* (2013.01)

(58) Field of Classification Search

CPC ..... F24D 19/1084; F24D 5/02; F24H 3/006; F24H 3/025; F24H 3/087; F24H 9/1881; F24H 9/2085; F24H 9/0063; F23N 2037/02; F23N 1/005; F23N 1/007; F23D 14/045; F23D 17/00

USPC ..... 126/116 A, 109, 99 A

See application file for complete search history.

(56) References Cited

U.S. PATENT DOCUMENTS 1,294,999 A * 2/1919 Brickman ..... F23D 11/10 239/431
2,625,992 A * 1/1953 Beck ..... F23D 14/045 431/156

(Continued)

FOREIGN PATENT DOCUMENTS

JP 61086513 A * 5/1986 ..... F23N 1/00
JP 62080429 A * 4/1987 ..... F23N 5/123

OTHER PUBLICATIONS

"Cat 5-173[1]—WeatherHawk Duct Furnace.pdf", Modine duct furnace catalogue; Modine Indoor Air Solutions; Jul. 2008.*

(Continued)

*Primary Examiner* — Gregory L Huson
*Assistant Examiner* — Daniel E Namay
(74) *Attorney, Agent, or Firm* — Merchant & Gould P.C.

(57) ABSTRACT

A high turndown furnace for an air handling system. In one example, the furnace includes a plurality of tubes divisible by four with a first modulating valve supplying gas to ¼ of the tubes and a second modulating valve supplying gas to ¾ of the tubes. In one aspect, the furnace is capable of providing a 16:1 turndown. In one aspect, the furnace is capable of providing seamless turndown operation throughout the entire firing range.

24 Claims, 11 Drawing Sheets

(51) Int. Cl.
*F24H 3/06* (2006.01)
*F23N 1/00* (2006.01)

(56) References Cited

U.S. PATENT DOCUMENTS 3,617,159 A * 11/1971 Arndt ..... F23N 5/08 431/6
5,052,367 A * 10/1991 Beavers ..... F24H 3/105 126/110 B
5,186,620 A 2/1993 Hollingshead
5,197,664 A * 3/1993 Lynch ..... F23N 5/242 126/116 A
5,368,476 A * 11/1994 Sugahara ..... F23D 14/26 431/285
5,667,375 A * 9/1997 Sebastiani ..... F23D 14/045 126/116 A
6,179,212 B1 1/2001 Banko
6,705,533 B2 * 3/2004 Casey ..... F23N 1/002 236/1 E
7,494,337 B2 2/2009 Specht et al.
7,850,448 B2 12/2010 Slaby
8,021,143 B2 9/2011 Slaby
8,206,147 B2 6/2012 Videto et al.
8,591,222 B2 * 11/2013 Sherrow ..... F23C 3/002 126/99 A
8,777,119 B2 7/2014 Griffin et al.
10,174,967 B2 * 1/2019 Schneider ..... F24H 3/087
2002/0155404 A1 * 10/2002 Casey ..... F23N 1/002 431/60
2002/0155405 A1 * 10/2002 Casey ..... F23N 1/002 431/60
2005/0239006 A1 * 10/2005 Specht ..... F23D 14/04 431/12
2006/0144049 A1 * 7/2006 Haffner ..... F23N 1/002 60/776
2006/0199121 A1 9/2006 Caskey
2008/0016875 A1 * 1/2008 Ryan ..... F02C 7/26 60/776
2010/0001087 A1 * 1/2010 Gum ..... F23N 1/005 237/2 A
2014/0165991 A1 * 6/2014 Noman ..... F24H 9/0068 126/116 A
2017/0176048 A1 * 6/2017 Schneider ..... F24H 3/087
2017/0211820 A1 * 7/2017 Perez ..... F24D 5/04
2017/0211822 A1 * 7/2017 Perez ..... F24D 19/1084
2017/0211823 A1 * 7/2017 Perez ..... F24D 19/1084
2017/0211824 A1 * 7/2017 Perez ..... F24D 19/1084
2017/0211834 A1 * 7/2017 Perez ..... F24D 5/04
2017/0211835 A1 * 7/2017 Perez ..... F24D 5/04
2017/0211836 A1 * 7/2017 Perez ..... F24D 5/04

OTHER PUBLICATIONS

"Wiring 5-451[1]—DFG.pdf", Duct furnace wiring diagrams; Modine Indoor Air Solutions; Nov. 2005.*

* cited by examiner

INDIRECT GAS FURNACE

RELATED APPLICATIONS

This application claims priority to U.S. Provisional Patent Application No. 62/371,419 (entitled INDIRECT GAS FURNACE), filed on Aug. 5, 2016, the entirety of which is incorporated herein.

BACKGROUND

Furnaces for air handling systems are known. Some furnaces are power vented using tubular heat exchangers. Other types of heat exchangers, such as drum/tube and clamshell heat exchangers are also used in some furnaces, but they are in some cases impractical for use in some air handling system configurations for a variety of reasons. In operation, the air to be heated is passed over the outside of the heat exchanger tubes, wherein each tube of the heat exchanger has a burner associated with it. The burners are arranged in a row (either horizontally or vertically) so that a flame on one burner will travel to the remaining burners. An example burner is an 'inshot' type burner manufactured by Beckett Gas (see U.S. Pat. No. 5,186,620), and is designed with flame passageways to assist in the flame travel between burners. The burner on one end of the burner row is ignited using an ignition source, for example a sparking or hot surface ignition source, and the flame travels to the remaining burners. A flame sensor at the other end of the burner row verifies that the flame is established along the entire row. A combustion fan draws the air for combustion through the heat exchanger and discharges it outside of the unit.

A flammable gas (typically natural gas or LP gas) is supplied to each burner by a manifold with an orifice feeding gas to each burner. The gas is supplied to the manifold by gas control valve(s) which are electronically controlled. One common configuration is a modulating control with a 4:1 turndown. The turndown is defined as the ratio of the maximum firing rate to the minimum firing rate of the burner and/or furnace. Higher turndown is desirable to achieve better temperature control on mild days. The modulation is achieved using a modulating valve which controls the gas flow to the burners in a variable manner. A shutoff valve (labeled combo valve in the drawings above) is used to shut off gas flow to the furnace when heat is not required. The 4:1 furnace uses a two speed combustion fan to maintain a proper fuel to air ratio at lower firing rates. Other common options for gas control are one stage (on/off) and two stage (high/low/off) control.

Many manufacturers are also using this type of furnace and furnace control in the residential HVAC industry. The level of modulation (turndown) varies from one manufacturer to the next. 2:1 modulation has been around for a long time while 4:1 modulation has been common in the industry for about 15 years. In recent years, manufacturers have been starting to achieve 5:1 modulation more readily and a few have managed 6:1 modulation with the inshot burner/tubular heat exchanger design. However, further improvements in attaining even higher levels of modulation are desired.

SUMMARY

A heating system is disclosed that achieves the relatively high turndown capabilities of a drum and tube heater in an application that utilizes the construction of a tubular type heat exchanger. In one example, the heating system is a furnace having a 16:1 turndown with seamless turndown operation. The furnace can include a first burner section with a first plurality of burner tubes and a second burner section with a second plurality of burner tubes. In one example, the second plurality of burner includes three times the number of tubes in the first plurality of burner tubes. As configured, a first plurality of burners is connected to each of the first plurality of burner tubes and a second plurality of burners is connected to each of the second plurality of burner tubes. The system can also include a gas manifold including a first inlet in fluid communication with a first plurality of outlets and can include a second inlet in fluid communication with a second plurality of outlets. In one aspect, the first plurality of burners is operably connected to the first plurality of outlets and the second plurality of burners is operably connected to the second plurality of outlets, wherein a first modulating valve is operably connected to the gas manifold first inlet and a second modulating valve is operably connected to the gas manifold second inlet.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
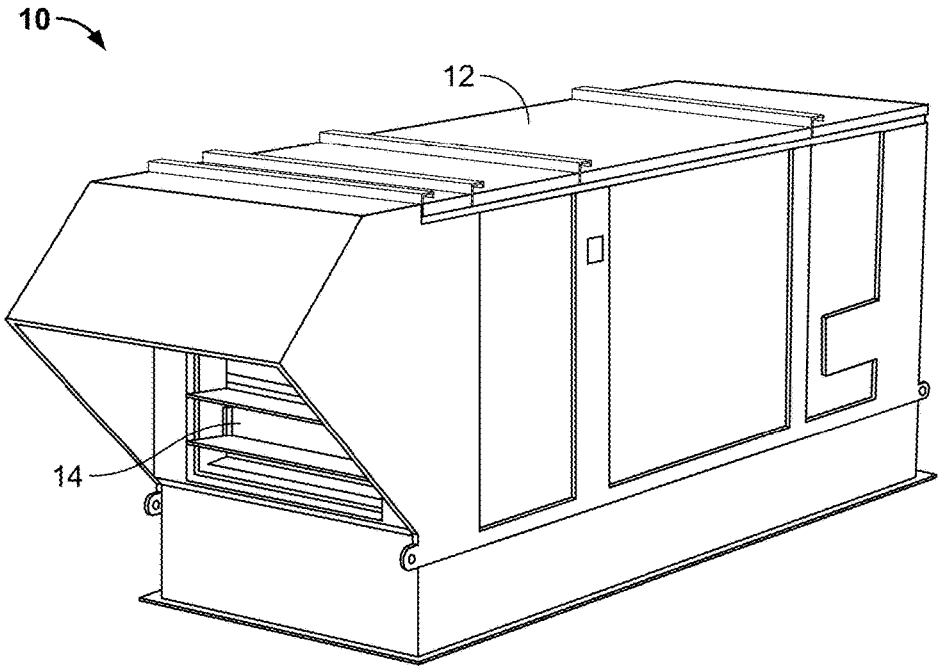
FIG. 1 is perspective view of a first embodiment of an air handling system including a heating system having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
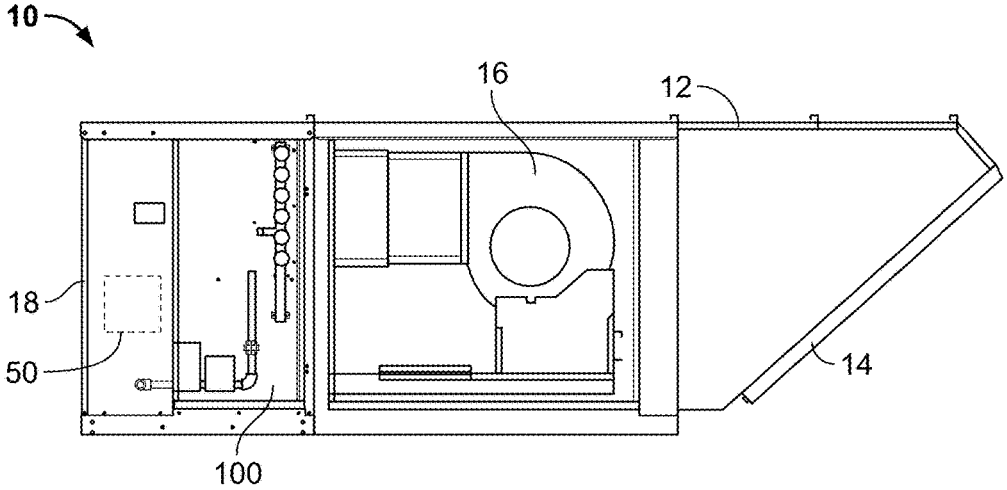
FIG. 2 is schematic cross-sectional view of the air handling system shown in FIG. 1.
Figure 3:
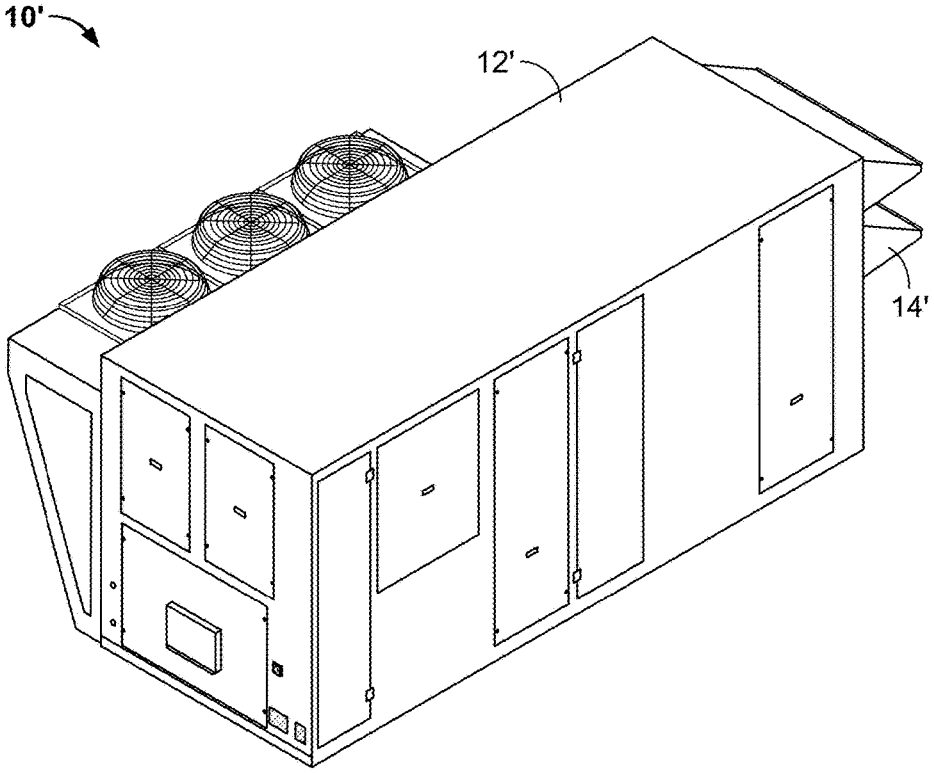
FIG. 3 is perspective view of a second embodiment of an air handling system including a heating system having features that are examples of aspects in accordance with the principles of the present disclosure.
Figure 4:
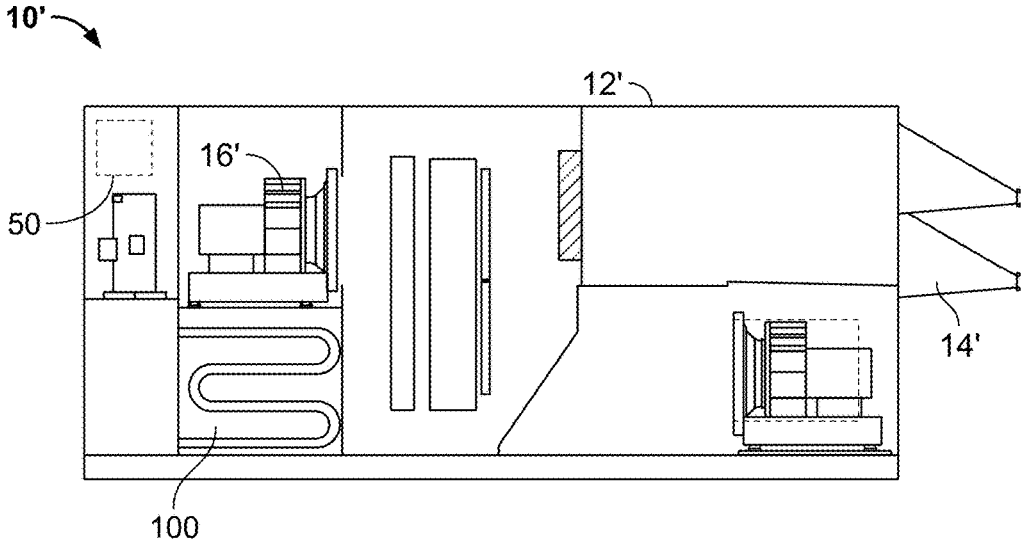
FIG. 4 is schematic cross-sectional view of the air handling system shown in FIG. 3.
Figure 5:
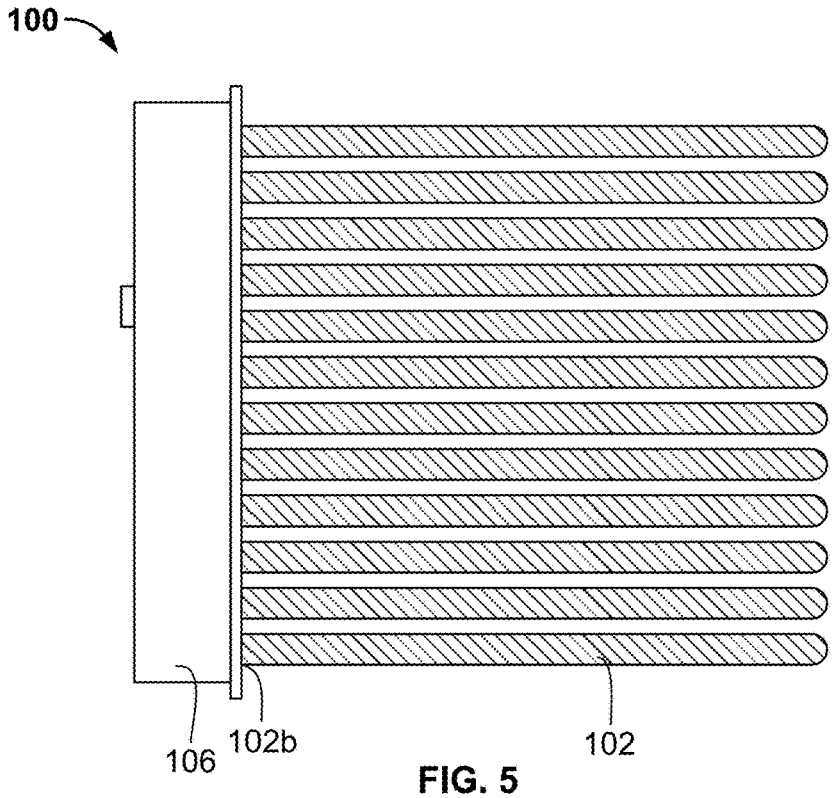
FIG. 5 is a side view of a heating system usable with the air handling systems shown in FIGS. 1 to 4.

Referring to FIGS. 1-2, an air handling system 10 for conditioning an airflow stream is presented. In one aspect, the air handling system 10 includes a heating system 100 for conditioning the airflow stream. The air handling system 10 is shown as including a housing 12 having at least an air intake 14, through which air can be delivered to the heating system 100, and including a fan 16 for delivering air through the heating system 100 to an outlet 18 from which the heated air can be delivered to a building space via ductwork. The outlet 18 can be located at either the end or bottom of the air handling system 10. A control system 50 may also be provided to operate the heating system 100, the fan 16, and other components of the air handling system 10. One skilled in the art of air handling system design will readily appreciate that the air handling system 10 can also include many other components to enable effective operation, such as filter, dampers, fans, refrigeration systems, and the like. FIGS. 3 and 4 show a second embodiment of an air handling system 10' including a heating system with a housing 12', an air intake 14', and a fan 16' that can also include the above described control system 50 and heating system 100.

Figure 6:
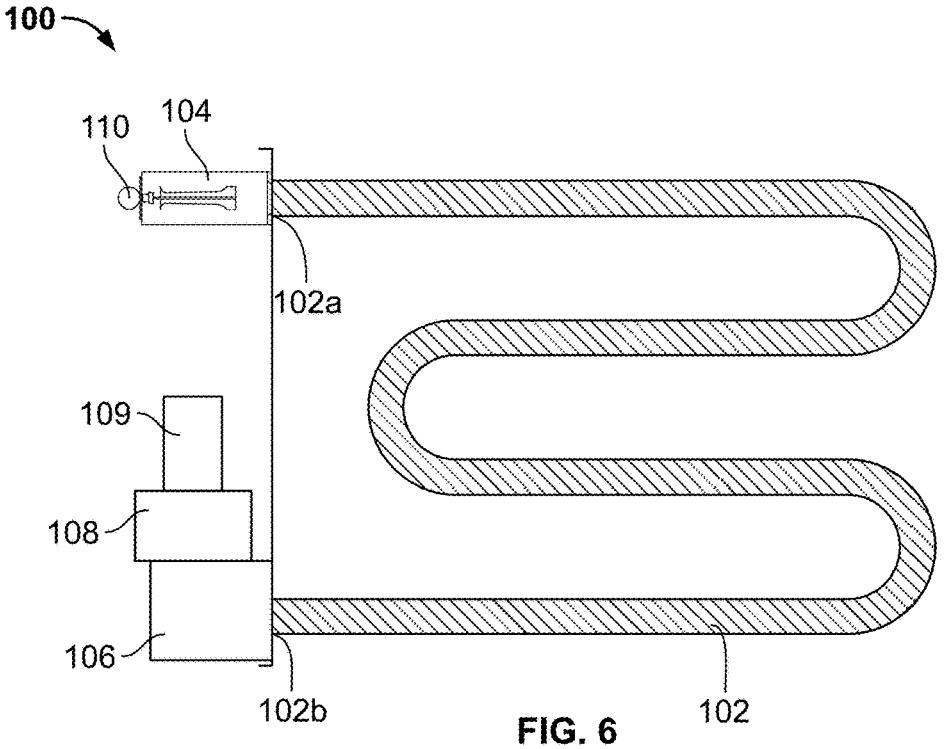
FIG. 6 is a top view of the heating system shown in FIG. 5.

Referring to FIGS. 5-12, the features of the heating system 100 are shown in further detail. As shown, the heating system 100 is configured as an indirect fired furnace having a plurality of burner tubes 102 disposed within the airflow stream in the air handling unit 10, 10'. As can be seen at FIG. 6, each burner tube 102 extends from a first end 102*a* to a second end 102*b*. As most easily seen at FIG. 5, the heating system 100 is provided with 12 tubes 102. A number of tubes evenly divisible by four is optimal to facilitate having a ¼ furnace section and a ¾ furnace section for achieving seamless 16:1 turndown operation. By use of the term "seamless modulation" it is meant that the output of the heating system 100 can be fully modulated between the minimum heating system output and the maximum heating system output. Other numbers of tubes besides twelve tubes may be used, albeit with reduced performance in some applications. In such an application where the total number of tubes in the furnace is not evenly divisible by four, the tubes are divided as close to a 25%/75% split as possible. For example, a 9 tube furnace can be divided into a 3 tube section and a 6 tube section which results in a 12:1 turndown ratio, but still maintains seamless modulation throughout the turndown range. In another example, a 14 tube furnace can be divided into a four tube section and a ten tube section and will have a 14:1 turndown ratio.

A burner 104 is disposed at the first end 102*a* of each burner tube 102 and injects a flame into each tube 102. This operation causes the tubes 102 to be heated which in turn causes the airflow stream passing across the tubes 102 within the air handling unit 10 to be heated. A suitable burner 104 for use in the disclosed heating system 100 is referred to as an "inshot" type burner and is disclosed in U.S. Pat. No. 5,186,620 issued on Feb. 16, 1993 and entitled GAS BURNER NOZZLE, the entirety of which is incorporated in its entirety by reference herein. With burners of this design, primary air is mixed with the gas as the gas passes through a Venturi portion of the burner. Secondary air is then introduced in a space where the flame is exposed between the end of the burner 104 and the inlet of the heat exchanger tube 102

The second ends 102*b* of the burner tubes are connected to a common collector box 106 such that the combustion gases from the burners 104 can be captured and appropriately exhausted to the atmosphere. A combustion fan 108 is placed in fluid communication with the collector box 106 to actively draw the gases through the tubes 102. A gas flue or stack (not shown) can be attached to the combustion fan 108 to ensure the combustion gases are appropriately exhausted. The combustion fan 108 can be a two-speed fan or a fan with fully modulating speed, for example via a variable frequency drive.

As shown, each of the burners 104 is connected to a gas manifold 110 which is in turn connected to a gas source 111, such as a natural gas pipe routed within a facility served by the air handling unit 10. As configured, the gas manifold 110 includes a main tube 112 which is separated into a first section 112*a* and a second section 112*b* by a partition member 114. The ends of the main tube 112 are also enclosed by end pieces 116, 118. Although a single tube 112 is shown as being used with the partition member 114, the first and second sections 112*a*, 112*b* could also formed by two non-connected tubes.

Figure 8:
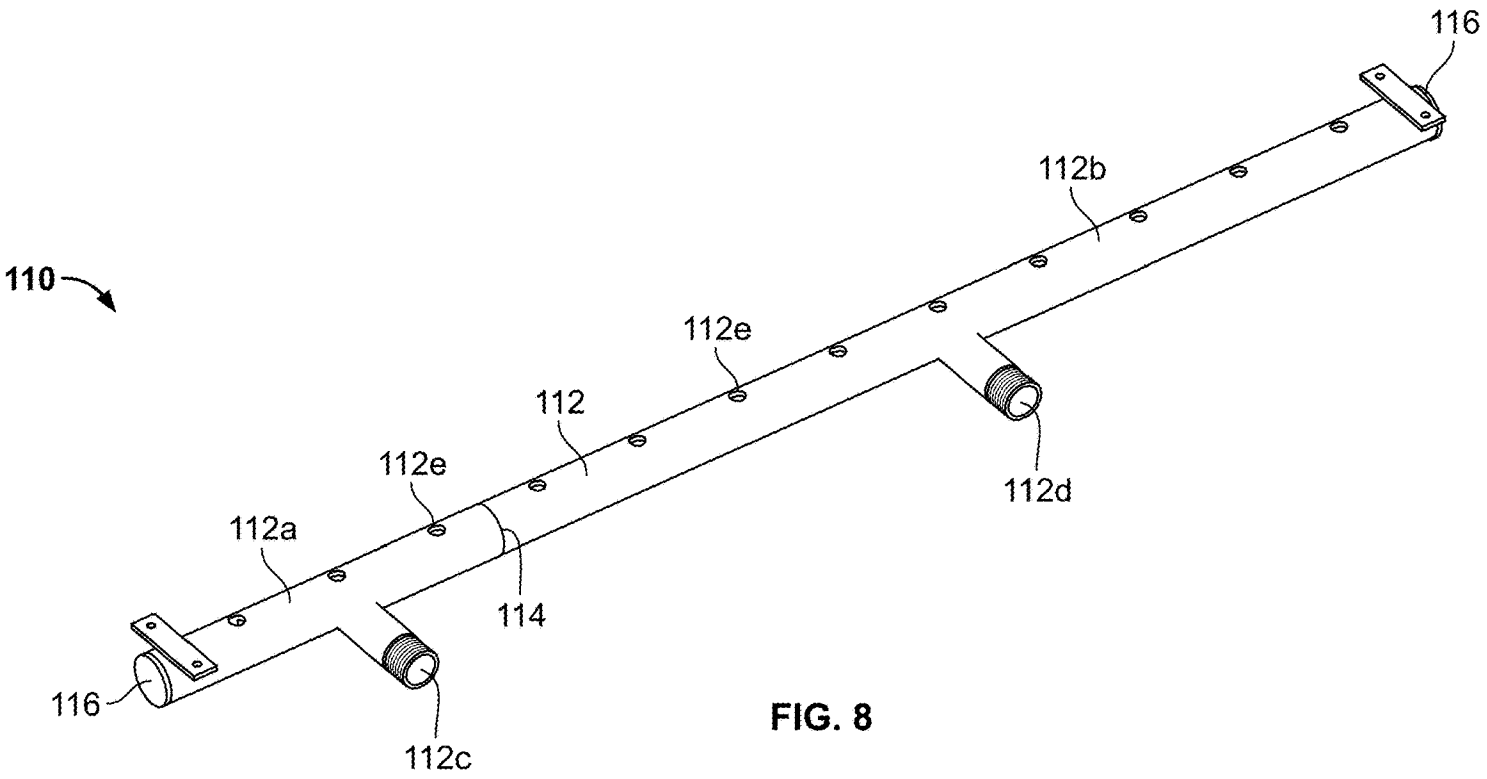
FIG. 8 is a perspective view of a gas manifold assembly of the heating system shown in FIG. 5.
Figure 9:
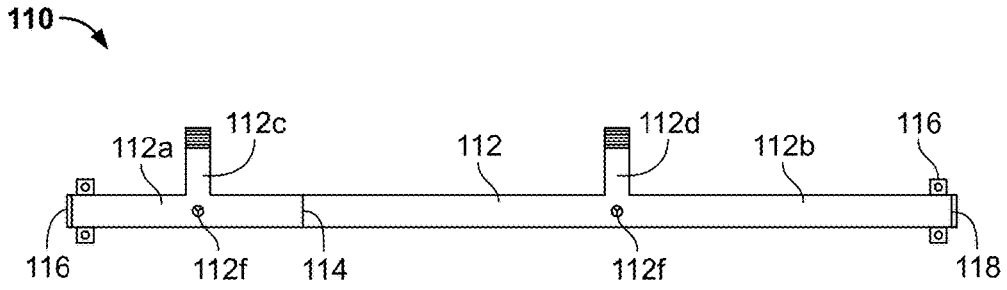
FIG. 9 is a first side view of the gas manifold assembly shown in FIG. 8.
Figure 10:
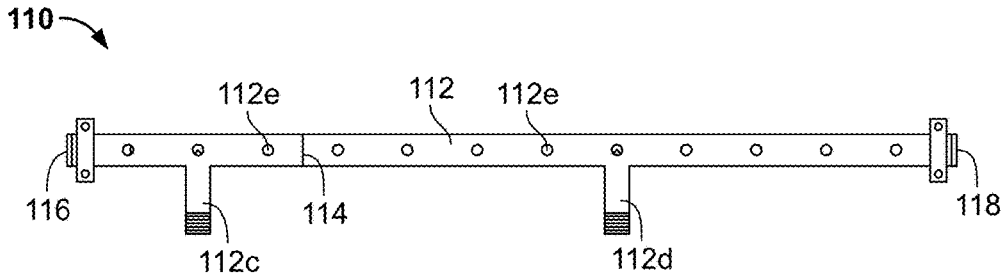
FIG. 10 is a second side view of the gas manifold assembly shown in FIG. 8.
Figure 11:
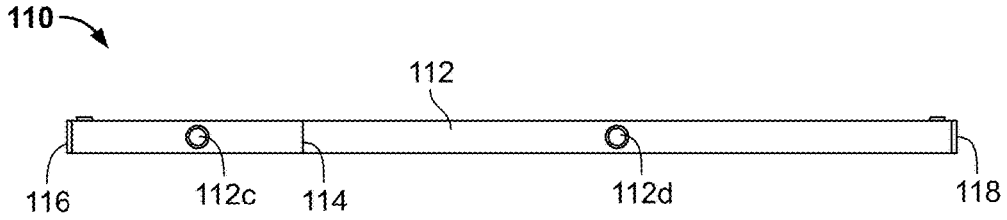
FIG. 11 is a third side view of the gas manifold assembly shown in FIG. 8.

As most easily seen at FIGS. 8 and 10, the main tube 112 includes a first gas inlet 112*c* associated with the first section 112*a* and a second gas inlet 112*d* associated with the second section 112*b*. The main tube 112 also includes a plurality of gas outlets 112*e*, each of which provides gas to a single burner 104 via the inlets 112*c*, 112*d*. As shown, the first section 112*a* includes three gas outlets 112*e* and thus serves three burners 104 while the second section 112*b* includes nine gas outlets 112*e* and thus serves nine burners 104. The manifold main tube 112 is also shown as having two test ports 112*f* During normal operation, the test port 112*f* is plugged. When a technician is making adjustments during the startup process, a pressure tap can be placed in the port(s) 112*f* to read the pressure in the manifold 112.

Figure 7:
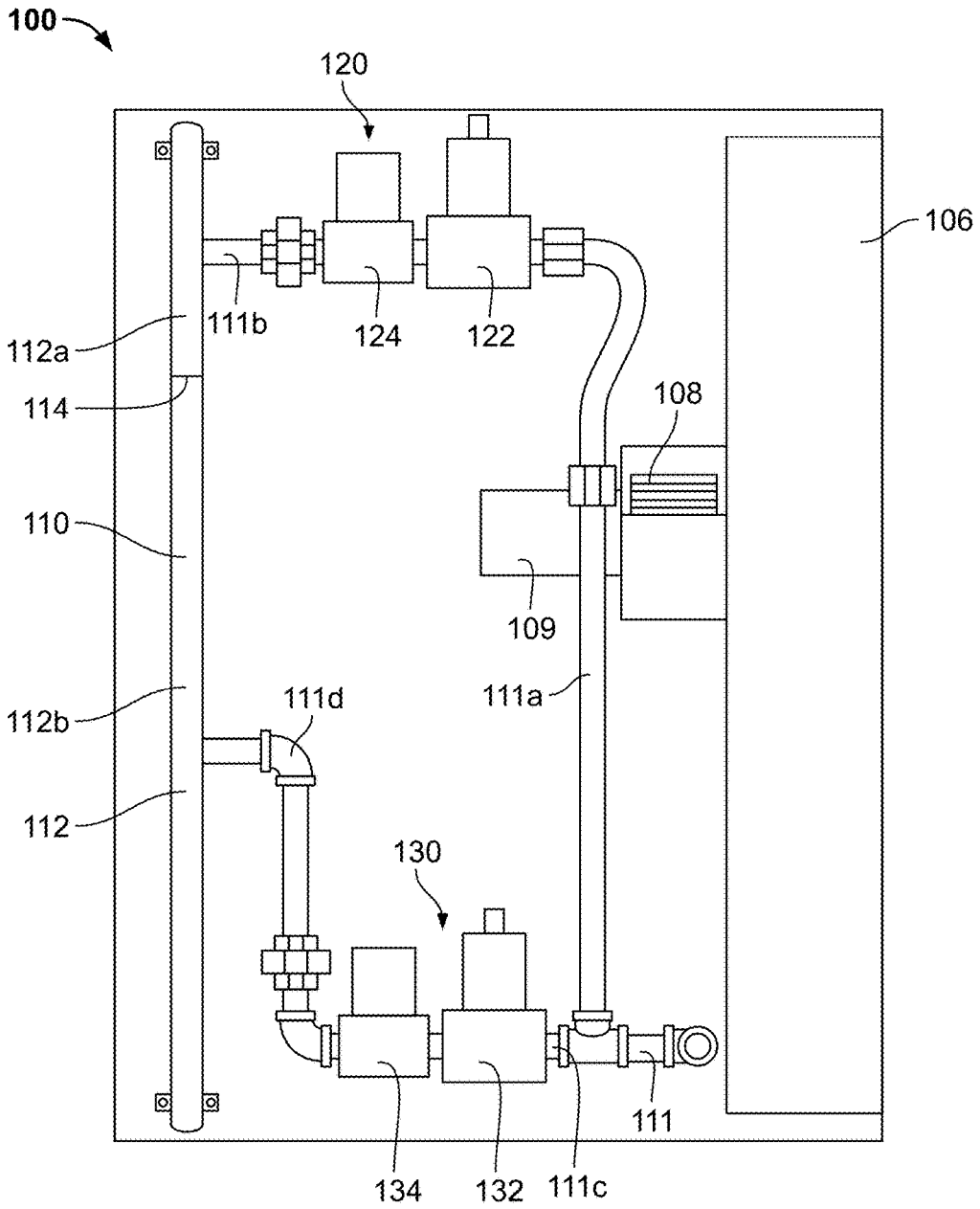
FIG. 7 is an end view of the heating system shown in FIG. 5.

Referring to FIG. 7, it can be seen that the heating system 100 includes a first valve train 120 and a second valve train 130. Each of the valve trains 120, 130 includes a shutoff or combination valve 122, 132 and a downstream modulating valve 124, 134. The first valve train 120 is connected to the gas source 111 via pipe segment 111*a* and to the manifold main tube first gas inlet 112*c* via pipe segment 111*b* while the second valve train 130 is connected to the gas source 111 via pipe segment 111*c* and to the manifold main tube second gas inlet 112*d* via pipe segment 111*d*. In operation, the shutoff or combination valves 122, 132 provide "on/off" control while the modulating valves 124, 134 provide modulating control to meter a desired amount of gas into the respective first and second manifold sections 112*a*, 112*b*.

Figure 12:
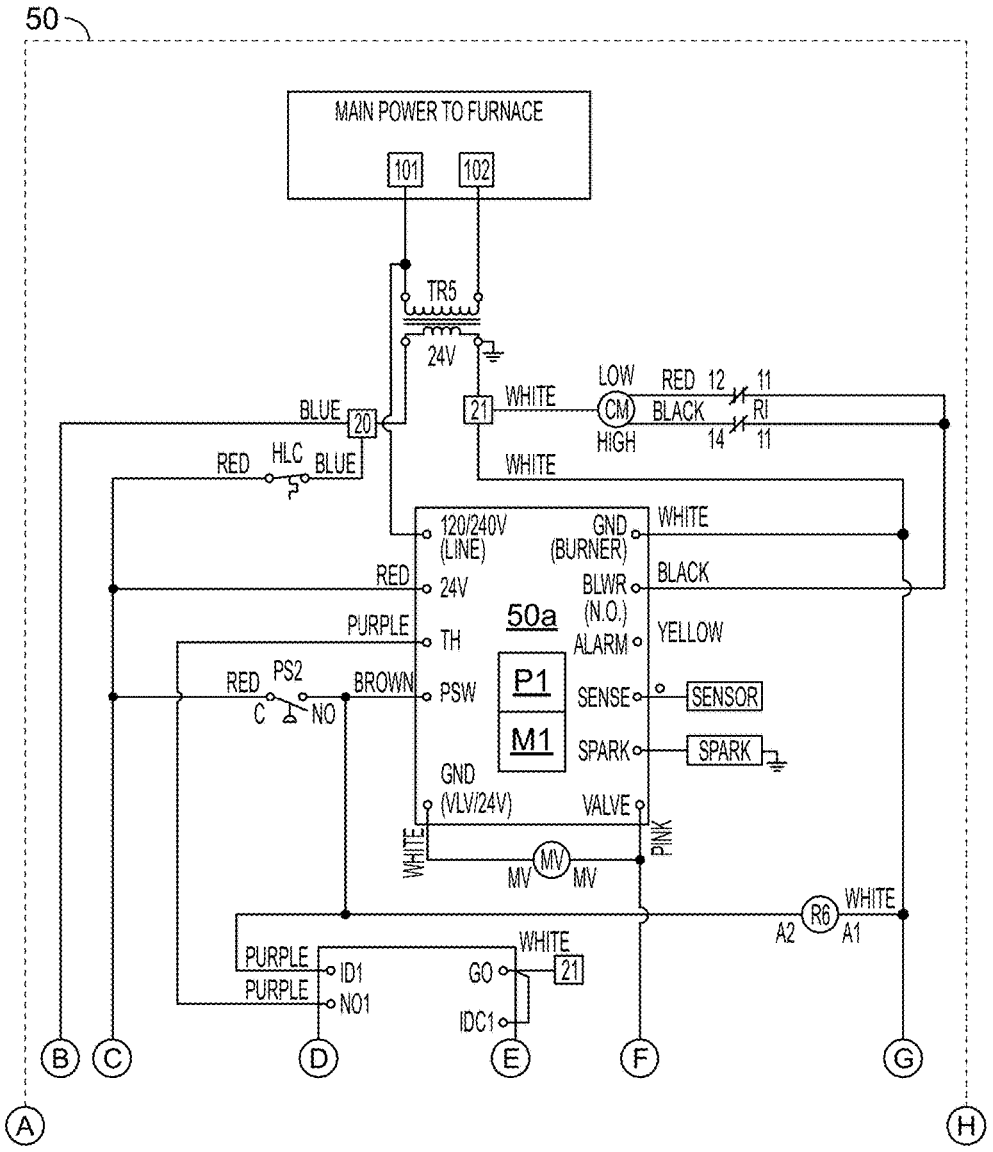
FIG. 12 is a schematic control system usable with the heating system shown in FIG. 5.
Figure 12:
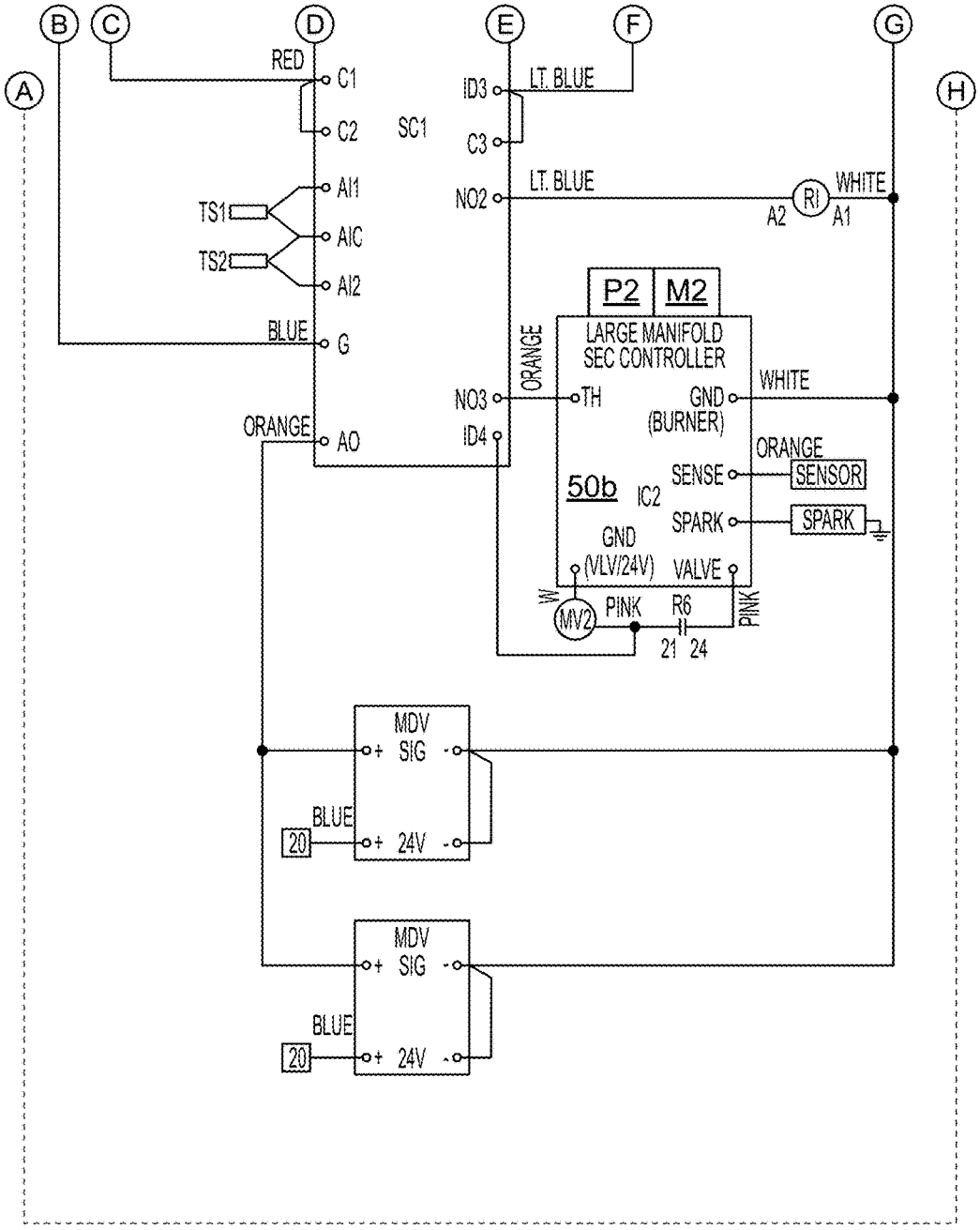

FIG. 12 shows a schematic for the control system 50. The electronic control system 50 is schematically shown as including multiple components and sub-controllers (e.g. 50*a*, 50*b*), each of which can include a processor (e.g. P1, P2) and a non-transient storage medium or memory (e.g. M1, M2), such as RAM, flash drive or a hard drive. The memory is for storing executable code, the operating parameters, system inputs, and input from an operator interface (if provided) while processor is for executing the code.

Electronic control system 50 is also shown as having a number of inputs and outputs that may be used for implementing the operation of the heating system 100. Example outputs are ignition/spark outputs (SPARK) to each of the burner sections, on/off/speed control (low/high) to the motor 109 (CM) for the combustion fan 108, open/closed operation of the shutoff valves 122 (MV), 132 (MV2), and modulation/position control of the valves 124, 134. Example inputs are downstream airflow (i.e. heated air) temperature, upstream air temperature, collector box pressure/flow, and flame sensors. The electronic control system 50 may also include a number of maps or algorithms to correlate the inputs and outputs of the control system 50.

In one configuration, the control system 50 activates the combustion fan motor upon a call for heat. A fan pressure switch PS2 provides a verification input of actual airflow to the control system 50. Once this verification is made, the valves 122, 132 are then allowed to open and operate. If the verification is not made, a first controller 50*a* responsible for the operation of the valves 122, 124 ensures that the valve 122 is automatically closed (e.g. power is cut for a normally closed valve). The controller 50*a* is also connected to a second controller 50*b* responsible for the operation of the valves 132, 134. This connection is made in such a way (e.g. with a relay) that if the pressure switch verification is not made, the first controller 50*a* cuts off power to the second controller 50*b*, thus ensuring that valve 132 cannot open.

In one aspect, each of the burners 104 associated with the modulating valves 124, 134 has a turndown of 4:1 or ¼, meaning the valve can modulate between a maximum rated firing rate down to one quarter of the maximum rate. Accordingly, shutting off the large section (e.g. valve 132) and running only the small section (e.g. valve 122), a turndown of as high as 16:1 can be achieved. This high turndown operation can be illustrated by an example installation using a 400,000 BTU/h furnace. The small section of the manifold is capable of 100,000 BTU/h while the large section is capable of 300,000 BTU/h. When the small section is turned down to minimum and the large section is off, a minimum firing rate of 25,000 BTU/h can be achieved which is 1/16th of 400,000 BTU/h. When only the small section is operating, the combustion fan speed will be controlled as necessary to ensure proper combustion. When the heat requirement reaches the level where the small section is operating at 100%, the furnace will be operating at 100,000 BTU/h which is 25% of the total heating output of the system. If additional heat is needed, the large section will be turned on and both sections will be modulated down to 25%. Since the whole 400,000 BTU/h furnace is now operating at 25%, the furnace is still able to maintain 100,000 BTU/h. Thus, the transition between operating the small section alone to operating both sections is "seamless" as no jump in output occurs. The manifold sections can then modulate up from there to whatever firing rate is needed to meet the heat demand. The combustion fan speed will again be controlled as necessary to maintain proper air for combustion. As noted previously, seamless modulation is achieved when the system heating output can be fully modulated between the minimum system heating output and the maximum system heating output. In this example, the minimum system heating output is equal to the heating output generated by the burners 104 associated with the first section 112*a* are at their minimum firing rate, and the maximum system heating output is equal to the sum of the heating output generated by all of the burners 104 of both sections 112*a*, 112*b* when at their maximum firing rate. This operation is illustrated in the method 1000 flow chart presented at FIG. 13 and in the graph shown at FIG. 14.

Figure 13:
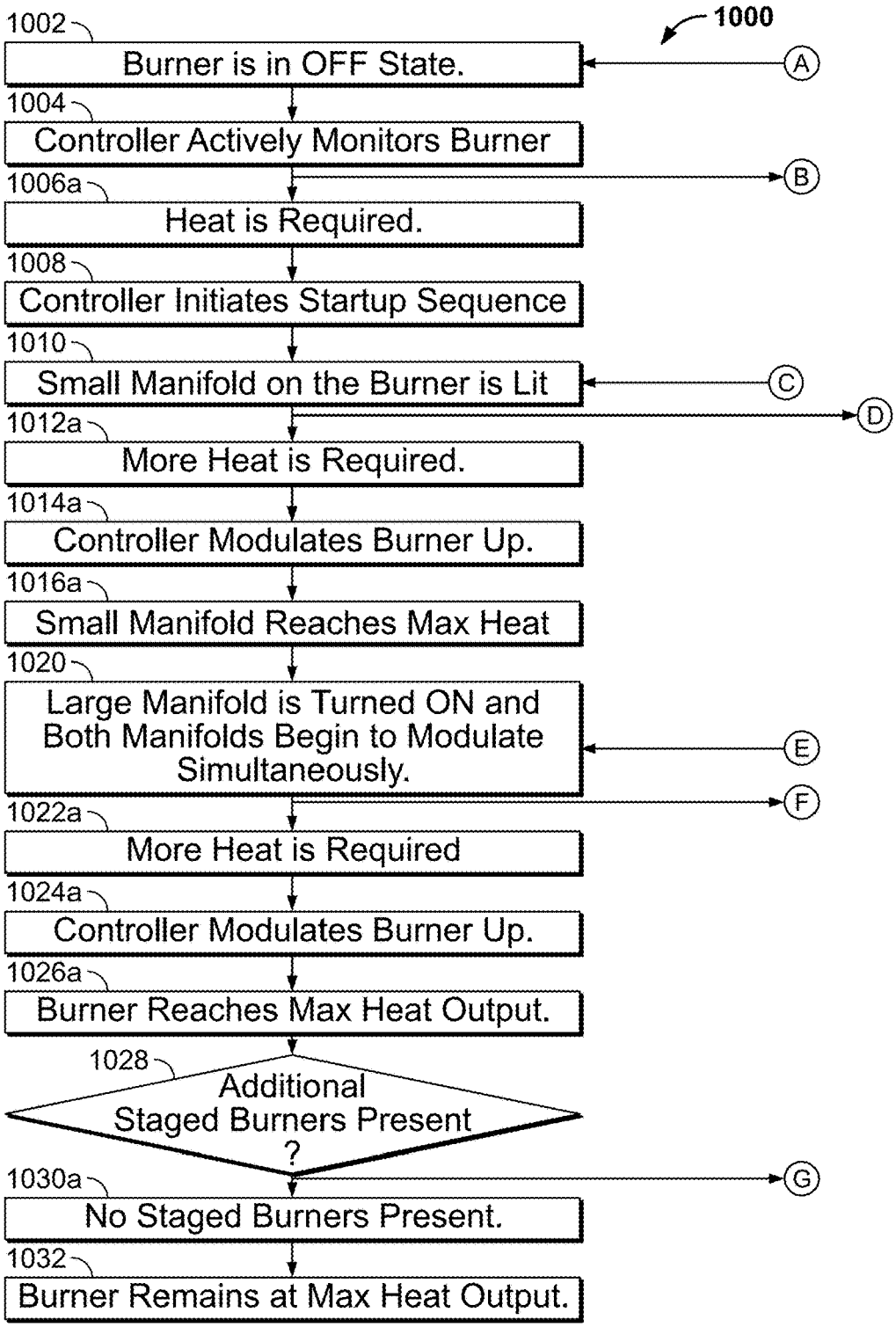
FIG. 13 is a flow chart showing a method of operation of the heating system shown in FIG. 5.
Figure 13:
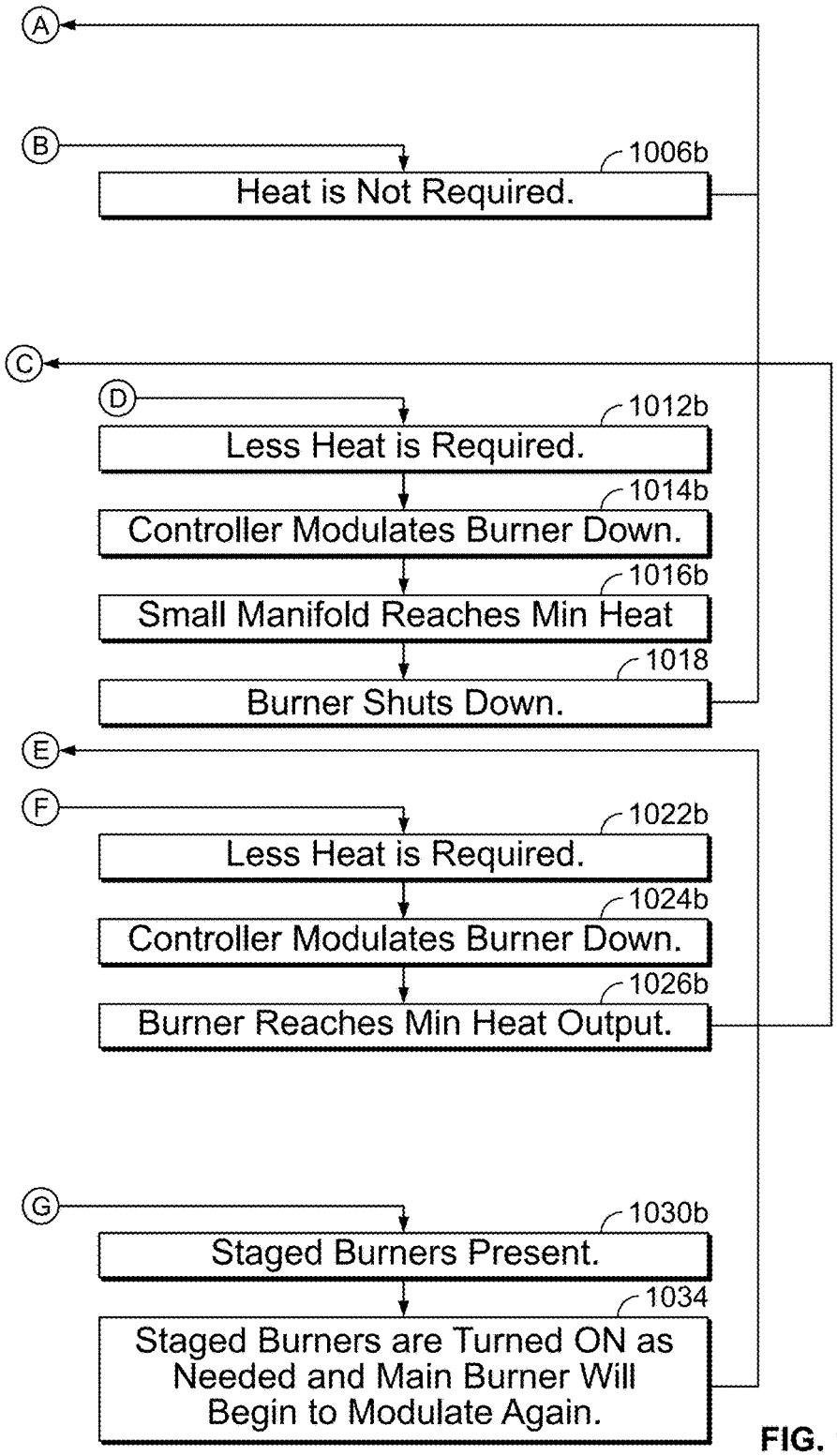

Referring to FIG. 13, an example control algorithm and process is presented for operating the heating system 100. At 1002, the burner is in an OFF state (e.g. valve 122, 132 are closed). At 1004, the controller actively monitors the status of the burner. At steps 1006*a*, 1006*b* the control system determines whether heat is required (1006*a*) or whether heat is not required (1006*b*). This determination can include the controller comparing a sensed temperature (e.g. in a return duct or in a conditioned space) against a temperature setpoint. If heat is required, the controller initiates a startup sequence 1008. The startup sequence can include activating the combustion fan motor 109, verifying activation of the fan 108 via a pressure sensor switch, opening valve 122, and modulating valve 124 to a minimum position.

Figure 14:
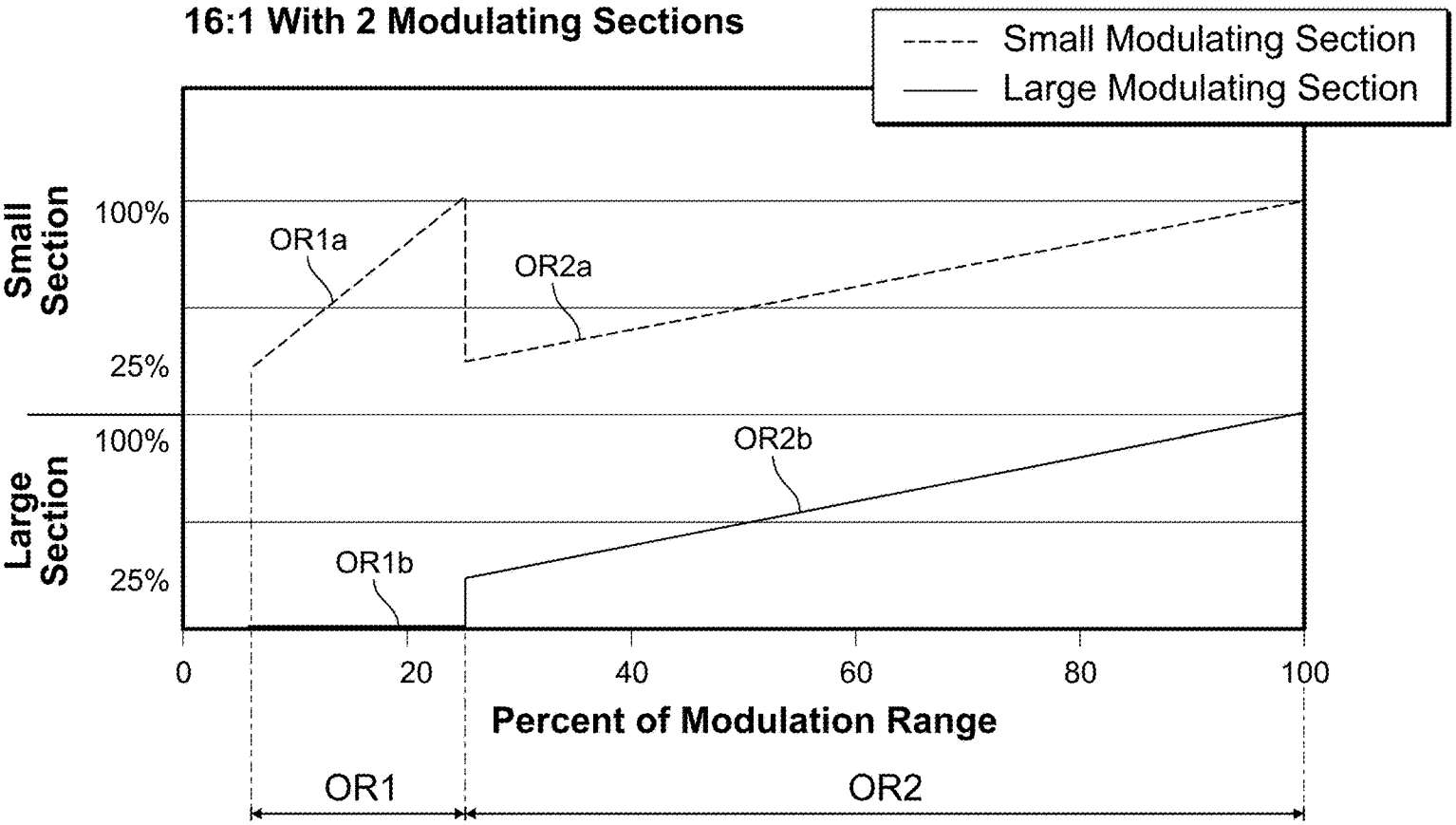
FIG. 14 is a graph showing the modulating operation of the heating system shown in FIG. 5.

Once the startup sequence is completed, the burners 104 associated with the first section 112*a* (i.e. the small section) are ignited at step 1010. At 1012*a*, 1012*b*, it is respectively determined whether more or less heat is required, for example, by comparing a sensed temperature value to a temperature setpoint. Where more or less heat is required, the controller modulates the valve 124 up or down at 1014*a*, 1014*b* to satisfy the load. With reference to FIG. 14, this modulation of valve 124 occurs over a first operational range OR1, wherein the valve 132 associated with the second (large) section 112*b* is in a closed position at OR1*b*, the valve 122 is open, and the valve 124 modulates alone to satisfy the heating load at OR1*a*. In the first operational range OR1, where the burners 104 of the first (small) section 112*a* have a turndown ratio of 4:1 and where there are three times as many burners 104 and tubes 102 associated with the large section 112*b* as the small section 112*a*, the valve 124 modulates the small section 112*a* between 25% and 100% of the burner maximum output at OR1*a*, which translates to effectively modulating between $1/16^{th}$ (i.e. $1/4^{th}$ of the system capacity modulated to a minimum at a 4:1 turndown ratio) and $1/4^{th}$ (i.e. $1/4^{th}$ of the system capacity modulated to a maximum at a 4:1 turndown ratio) of system capacity.

If the burners 104 of the first section 112*a* reach a minimum heat output at 1016*b* (i.e. valve 124 is in a minimum position) and less heat is required, the burner shuts down at 1018 and the system returns to 1002. If the burners 104 of the first section 112*a* reach a maximum heat output at 1016*a* (i.e. valve 124 is in a maximum position) and further heat is still required, the large manifold is activated at 1020. Activation of the large manifold 1020 can include opening the valve 132, modulating valve 134 to a minimum position, and igniting the burners 104 associated with the second section 112*b*.

FIG. 13 shows step 1020 as indicating that the burners 104 of both the first and second sections 112*a*, 112*b* are modulated together to satisfy the heating load. However, other approaches may be utilized. For example, the burners 104 associated with the first section 112*a* can be held at maximum output and the burners 104 of the second section 112*b* can be modulated to satisfy the heating load. At 1022*a*, 1022*b*, the controller determines whether more or less heat is respectively required, for example by comparing a sensed temperature value to a temperature setpoint. Where more or less heat is required, the controller modulates the valves 124 and 134 up or down together at 1024*a*, 1024*b* to satisfy the load. With reference to FIG. 14, this modulation of valves 124, 134 occurs over a second operational range OR2, wherein both valves 124, 134 modulate to satisfy the heating load at OR2*a* and OR2*b*, respectively. In the second operational range OR2, where the burners 104 of the sections 112*a*, 112*b* have a turndown ratio of 4:1, the valves 124, 134 modulate the burners 104 of the sections 112*a*, 112*b* between 25% and 100% of the burner maximum output, which translates to effectively modulating between $1/4^{th}$ (i.e. 100% of the system capacity modulated to a minimum at a 4:1 turndown ratio) and 100% of system capacity (i.e. 100% of the system capacity modulated to a maximum at a 4:1 turndown ratio). Because the maximum system output at the end of the range OR1 equals the minimum system output at the beginning of range OR2, seamless modulation between 25% total system output and 100% total system output results.

If the burners 104 of the first and second sections 112*a*, 112*b* reach a minimum heat output at 1026*b* (i.e. valves 124, 134 are both in the minimum position) and less heat is required, valve 132 closes to shut down the burners 104 associated with the second section 112*b*, and the system returns to 1010. If the burners 104 of the first and second sections 112*a*, 112*b* reach a maximum heat output at 1026*a* (i.e. valves 124, 134 are in a maximum position) and further heat is still required, the system determines whether additional staged burners (i.e. stages typically provided with non-modulating, two-position burner control valves) are present at 1030*a*, 1030*b*. Where no additional staged burners are present, the valves 124, 134 remain in their maximum positions such that the burners 104 of the first and second sections 112*a*, 112*b* remain at their maximum heating output at 1032. Where additional staged burners are present, the staged burners are turned on (e.g. valve opened, burners ignited, etc.) at 1034 and the system returns to steps 1022*a*, 1022*b* where the valves 124, 134 can return to modulating to satisfy the heating load. As the heating load decreases, the staged burner(s) can be deactivated sequentially.

Where the valves 124, 134 are modulated together at 1020, the system will beneficially provide even heating across all of the tubes 102 at certain operating output ranges (e.g. total heat output required is greater than 25% of maximum) to prevent stratification. During such times, the furnace or heating system will be temporarily operating at an effective turndown equaling the turndown of the individual valves, which in this example is a 4:1 turndown.

As noted above, additional staged or modulating burners/furnaces can be provided and can be shut off independently of the modulating furnace valves 124, 134. In this configuration, the overall turndown of the unit will be increased (e.g. one additional furnace of the same capacity=32:1 turndown, two additional furnaces of similar capacity=48:1 turndown, etc.). The additional furnace(s) can be placed in either a parallel or series configuration.

Achieving a 16:1 modulation with a single tubular-type furnace will provide industry leading turndown. This improvement over the prior art will allow air handling and makeup air units to achieve more precise control of supply air temperature than what has been previously possible. This becomes especially important on mild days where only a small amount of heat is needed. On furnaces with less advanced turndown, mild days present a challenge because the minimum firing rate of the furnace will still provide more heat than is needed to condition the air. This results in the furnace staging on and off in an attempt to add some heat to the air without overheating it. This staging creates undesirable temperature swings that negatively affect occupant comfort. The 16:1 turndown will allow our furnace to modulate down to the precise amount of heat needed to properly condition the air.

Another option that could be used to achieve 16:1 modulation is to use a single modulation valve near the inlet to the furnace. The modulated gas can then be routed to various sections of the manifold with a simple on/off shutoff valve used to control the flow of gas to each manifold section. However, a disadvantage with this setup is the inability to maintain proper firing rate settings as manifold sections are turned on and off. Minimum and maximum firing rates on inshot burner/tubular heat exchanger furnaces are typically set by adjusting the gas control valves. To achieve proper turndown and combustion, it is important that each manifold section operate at the proper minimum and maximum firing rates they are designed for. If a single modulating valve is used and the gas control valves are set when the entire furnace is operating, the high and low fire set points will change when section(s) of the manifold are turned off. This means that the furnace will not achieve the turndown it is designed for and portions of the furnace will be overfired while others are underfired. This will result in poor combustion performance and reduced furnace life. Accordingly, the disclosed heating system or furnace 100 will eliminate all these issues by allowing the firing rates of each manifold section to be adjusted independently without affecting the adjustment of the other manifold sections.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

What is claimed is:

1. A heating system comprising:

(a) a first plurality of burner tubes;

(b) a second plurality of burner tubes, wherein the second plurality of burner tubes includes three times the number of tubes in the first plurality of burner tubes;

(c) a first plurality of burners connected to each of the first plurality of burner tubes;

(d) a second plurality of burners connected to each of the second plurality of burner tubes;

(e) a gas manifold including a first inlet in fluid communication with a first plurality of outlets and including a second inlet in fluid communication with a second plurality of outlets, wherein the first plurality of burners is operably connected to the first plurality of outlets and the second plurality of burners is operably connected to the second plurality of outlets;

(f) a first modulating valve operably connected to the gas manifold first inlet; and (g) a second modulating valve operably connected to the gas manifold second inlet (h) wherein the heating system has a turndown ratio of at least 12:1 and has seamless modulation between a minimum heating output and maximum heating output with the maximum heating output being no greater than 12 times the minimum heating output.

2. The heating system of claim 1, wherein each of the first and second plurality of burners have a turndown ratio of 4:1.

3. The heating system of claim 2, wherein the first plurality of burners accounts for ¼ of the maximum heating output rating and the second plurality of burners accounts for ¾ of the maximum heating output rating.

4. The heating system of claim 1, wherein each of the first and second plurality of burners is an inshot-type burner.

5. The heating system of claim 1, wherein the first plurality of burner tubes includes three burner tubes and the second plurality of burner tubes includes nine burner tubes for a total of twelve burner tubes.

6. The heating system of claim 1, further including a combustion fan and a motor for driving the combustion fan.

7. The heating system of claim 1, further comprising a control system for operating the first and second modulating valves.

8. The heating system of claim 7, further comprising a first ignition source for igniting the first plurality of burners and a second ignition source for igniting the second plurality of burners.

9. The heating system of claim 1, wherein the control system opens a first shutoff valve connected to the gas manifold first inlet, closes or holds closed a second shutoff valve connected to the gas manifold second inlet, and modulates the first modulating valve in a first operational range to satisfy a temperature setpoint.

10. The heating system of claim 9, wherein the first operational range includes operating the first modulating valve to result in the heating system operating between $1/16^{th}$ of the total maximum system output and $1/4^{th}$ of the total maximum system output.

11. The heating system of claim 10, wherein the control system modulates both the first and second modulating valves in a second operational range to satisfy the temperature setpoint.

12. The heating system of claim 11, wherein the second operational range includes operating the first and second modulating valves to result in the heating system operating between $1/4^{th}$ of the total maximum system output and the total maximum system output.

13. The heating system of claim 9, wherein the control system modulates both the first and second modulating valves in a second operational range to satisfy the temperature setpoint.

14. The heating system of claim 13, wherein the second operational range includes operating the first and second modulating valves to result in the heating system operating between $1/4^{th}$ of the total maximum system output and the total maximum system output.

15. A method of operating a heating system having a maximum system output, the method comprising:

(a) modulating a first control valve to control a first burner tube section such that a temperature setpoint is maintained over a first operational range, the first operational range being between $1/16^{th}$ of the total maximum system output and $1/4^{th}$ of the total maximum system output; and (b) modulating the first control valve and a second control valve to respectively control the first burner tube section and a second burner tube section such that the temperature setpoint is maintained over a second operational range, the second operational range being between $1/4^{th}$ of the total maximum system output and the total maximum system output (c) wherein the heating system has a turndown ratio of at least 12:1 and has seamless modulation between a minimum heating output and maximum heating output with the maximum heating output being no greater than 12 times the minimum heating output.

16. The method of claim 15, wherein the modulation of the first control valve is controlled by a first controller of a control system and the modulation of the second control valve is controlled by a second controller of the control system.

17. The method of claim 16, further including activating a combustion fan and verifying operation of the combustion fan prior to modulating the first and second control valves.

18. The method of claim 17, wherein the step of verifying operation of the combustion fan is accomplished by a pressure switch.

19. The method of claim 18, wherein power from a power source is cut from the first controller when the pressure switch is in a first position that correlates to the combustion fan being inactive.

20. The method of claim 19, wherein the first controller cuts power to the second controller when the pressure switch is in the first position.

21. A heating system comprising:

(a) a first burner section including a first plurality of burner tubes, a first plurality of burners connected to each of the first plurality of burner tubes, and a first modulating valve for controlling a firing rate of the first plurality of burners between a first minimum firing rate and a second minimum firing rate;

(b) a second burner section including a second plurality of burner tubes, a second plurality of burners connected to each of the second plurality of burner tubes, and a second modulating valve for controlling a firing rate of the second plurality of burners between a second minimum firing rate and a second maximum firing rate;

(c) wherein the heating system has a minimum heating output equaling the first minimum firing rate and has a maximum heating output equal to the sum of the first and second maximum firing rates, wherein the maximum heating output is no greater than 12 times the minimum heating output such that the heating system has a turndown ratio of at least 12:1, wherein the heating system has seamless modulation between the minimum heating output and the maximum heating output.

22. The heating system of claim 21, further comprising an electronic controller for controlling the position of the first and second modulating valves.

23. The heating system of claim 21, wherein the second plurality of burner tubes includes at least twice the number of burner tubes as the first plurality of burner tubes.

24. The heating system of claim 21, wherein the first and second plurality of burners each have a turndown ratio of 4:1.

* * * * *